US006868643B1

(12) United States Patent
Williams

(10) Patent No.: US 6,868,643 B1
(45) Date of Patent: Mar. 22, 2005

(54) INTEGRATED SYSTEM FOR CONTROLLING WATER INTRUSION AND AIR MOVEMENT THROUGH EXTERIOR WALL CONSTRUCTION

(76) Inventor: Mark F. Williams, 945 Tennis Ave., Maple Glen, PA (US) 19002

( * ) Notice: Subject to any disclaimer, the term of this patent is extended or adjusted under 35 U.S.C. 154(b) by 102 days.

(21) Appl. No.: 10/200,259

(22) Filed: Jul. 23, 2002

(51) Int. Cl.[7] ..... E04B 1/70; E02D 19/00

(52) U.S. Cl. ..... 52/302.1; 52/169.14; 52/408; 52/459; 52/517; 52/302.3

(58) Field of Search ..... 52/302.1, 302.3, 52/169.5, 169.19, 408, 459, 517, 220.8, 309.8, 741.4, 58

(56) References Cited

U.S. PATENT DOCUMENTS 4,074,492 A * 2/1978 Simpson et al. ..... 52/419
4,316,833 A * 2/1982 McGroarty ..... 524/447
4,545,158 A * 10/1985 Rizk ..... 52/79.1
4,852,316 A * 8/1989 Webb ..... 52/235
5,287,665 A * 2/1994 Rath, Jr. ..... 52/220.8
5,979,131 A 11/1999 Remmele
6,108,991 A * 8/2000 Hagan et al. ..... 52/302.3
6,224,700 B1 * 5/2001 Oakley ..... 156/71
6,233,890 B1 * 5/2001 Tonyan ..... 52/302.3
6,238,766 B1 * 5/2001 Massett et al. ..... 428/99
6,355,333 B1 * 3/2002 Waggoner et al. ..... 428/174
6,410,118 B1 * 6/2002 Reicherts et al. ..... 428/141
6,453,628 B2 * 9/2002 Traxler ..... 52/169.14
6,516,580 B1 * 2/2003 Maietta ..... 52/483.1
6,543,199 B1 * 4/2003 Tomlinson et al. ..... 52/746.11
6,550,212 B2 * 4/2003 Lubker, II ..... 52/741.13
2001/0034984 A1 * 11/2001 Murphy et al. ..... 52/204.5

* cited by examiner

*Primary Examiner*—Brian E. Glessner
(74) *Attorney, Agent, or Firm*—C. J. Husar, Esq.

(57) ABSTRACT

An integrated moisture/air barrier system that serves to mitigate the penetration of water and air around or through various types of exterior wall building sheathing products such as plywood, OSB, gypsum board, cement board, rigid foam boards and foil-faced composition products. The moisture/air barrier surface is preferably installed as a step in the manufacturing process for certain types of sheathing such as wood or gypsum-based products. However, it may also be installed in-situ in instances where the pre-coated units are not readily available or the factory surface needs to be supplemented at joints or terminations. The material used in forming the moisture barrier is urethane or urethane/silicone that is sprayed, squeegeed, applied by brush or roller and includes additives to aid the coating's workability and retard the growth of mold/fungi. The urethane and/or urethane/silicone coating is readily compatible with various known sheet flashing materials and common construction materials and readily bonds thereto.

92 Claims, 5 Drawing Sheets

INTEGRATED SYSTEM FOR CONTROLLING WATER INTRUSION AND AIR MOVEMENT THROUGH EXTERIOR WALL CONSTRUCTION

CROSS-REFERENCE TO RELATED APPLICATIONS

This application is closely related to Ser. No. 09/692,226, filed on Oct. 26, 2000, entitled, Multi-Component Flashing Systems, now U.S. Pat. No. 6,401,401 and Ser. No. 09/777,844, filed on Feb. 7, 2001, entitled, Pre-Folded Flashing Systems and Method, now U.S. Pat. No. 6,401,402, both by the same inventor as the subject application and also another earlier patent entitled Multi-Component Elastomeric Materials For A Building Flashing System issued to Williams et al, as U.S. Pat. No. 5,899,026 on May 4, 1999.

BACKGROUND OF THE INVENTION

The building envelope has many purposes, some of which are functional, while others are aesthetic in nature. Two of the most significant functional purposes are controlling water intrusion and controlling air movement.

Most exterior building envelopes are composed of both vertical surfaces (that are walls) and steep or low slope surfaces (that are roofs). With specific regard to the exterior wall, the outer surface is generally covered with a material that is referred to as a siding or cladding.

Behind many types of siding material, is a layer of secondary protection to minimize the passage of water and air. Buildings that are considered light frame construction; i.e., those with either wood or metal studs, usually include a sheathing material. The sheathing is attached to the frame structure. Because many sheathing products are either wood-base or gypsum-base, they will deteriorate if exposed to water for an extended period of time. Accordingly, these types of sheathing products are typically covered with a sheet material to provide secondary protection for the sheathing and structural members.

Therefore, the outer surface of the aforementioned siding or cladding provides both an aesthetic and functional role in that it provides the overall visual appearance of the building and functions to exclude most water from penetrating to the underlying sheathing and frame work construction. The aforementioned layer of secondary protection is intended to stop incidental water from reaching the underlying construction and retard the ingress and egress of air as well.

Many field investigations and laboratory studies have shown that water that enters past the exterior face of the siding may cause damage to the underlying construction if the secondary protection is not present or operational. In addition to the water sensitive sheathing products previously referenced, many other related construction materials will deteriorate due to the long term effects of water intrusion. Also, in conditions of high relative humidity, air that moves through the exterior wall construction may contribute to the water intrusion problem when water vapor condenses on sheathing or structural members. Finally, if water remains on the surface of certain types of wood or paper-based products within the wall system, the growth of certain fungi (mold) may occur.

Some types of mold spores are considered undesirable and may trigger allergic-type reactions in certain individuals with a sensitivity to these fungi. Therefore, it is desirable to control water intrusion and air movement through exterior wall construction, and mitigate the accumulation of water within the exterior wall sheathing and structure. In certain cases, such water will cause: 1) deterioration of the underlying construction materials or components; and 2) foster the growth of fungi/mold which may be an irritant to hypersensitive building occupants. The mold concern has been receiving increased attention nationwide to such a point that the insurance industry has found it necessary to increase insurance rates or cease writing certain policies to help offset their losses due to mold damage claims arising therefrom.

To date, individual exterior wall materials and components have been developed and sold without attempting to provide an overall integrated system for controlling water intrusion and air movement in completed wall assemblies.

The instant patent application builds upon two previously cited patents which were recently issued to this inventor. It also draws upon the building diagnostic expertise of the inventor, and provides a new approach for protecting exterior wall sheathing products as well as other underlying building materials. It has been found that elastomeric membrane-like materials such as urethane based coatings or hybrid urethane-silicone coatings can be applied over the surface of certain sheathing products, wood or gypsum based, preferably as a final step in the manufacturing process of theses products. Where sheathing products are not prefinished with the membrane-like material, these uncoated sheathing products may be readily coated with elastomeric membrane-like materials in the field. Further, the subject application can be used over the entire surface of water sensitive sheathing products (i.e. gypsum and wood based products) as well as the joints between sheets of sheathing boards and around through-wall penetrations. Some types of sheathings, such as rigid foam boards, (Owens Corning® Extruded Polystyrene or equal), foil faced composition products, (Tyco Thermo Ply® or equal) or cement based sheathings, (National Gypsum Company Perma Base® or equal) have water resistant surfaces, and may only require specialized treatment at the joints between sheets and through-wall penetrations in order to control water intrusion and air movement through the exterior wall construction. A combination of several different types of sheathing products sometimes occurs on residenial and light commercial projects.

DISCUSSION OF THE PRIOR ART

To date, products providing the secondary protective layer behind the siding and in front of the water sensitive sheathing have been classified as weather resistive barriers or air barrier-type products. Weather resistive barriers are principally paper-based, felt-based or polymeric sheet products applied to the outer surface of the exterior sheathing. Air barriers are typically polymeric sheet products applied to either the outer surface of the exterior sheathing or the interior face of the wall studs prior to installation of the interior wallboard. Recently, a trowel or roller-applied weather barrier that is acrylic based has received patent recognition, i.e. U.S. Pat. No. 5,979,131 issued to Remmele et al on Nov. 9, 1999. In the Remmele et al, '131 patent, the materials include an acrylic latex-based product, used in conjunction with a first layer of adhesive/seal applied to the sheathing, followed by a layer of insulation board, a base coat (unidentified), a mesh layer, and an additional base coat with a final coat of acrylic base or silicone enhanced texture wall coating.

Another, more recent patent, U.S. Pat. No. 6,355,333 issued to Waggoner et al, on Mar. 12, 2002, is confronted with the same problem of water/moisture penetration.

However, Waggoner et al, '333 deals with it in a manner somewhat different from Remmele et al, '131. Waggoner et al, '333 discloses an EIFS system utilizing stucco as the finished exterior material. However, the problem of moisture penetration is present and of considerable concern here also. Waggoner et al, '333 attempts to solve the problem by installing a sheet of polyethylene material, such as TYVEK®. However, in an effort to induce drainage of water away from the building structure, the polyethylene sheet material is directed through a pair of rollers that imparts a corrugated profile to the sheet. Upon installation, the sheet material is applied over the wood sheathing with the corrugations oriented vertically to serve as conduits for draining any water that penetrates the outer layers thereof.

The instant invention is significantly different from the Remmele et al, '131 and Waggoner et al, '333 disclosures in several specific ways. Firstly, the instant invention relies upon elastomeric membrane-like coating materials such as, (Pecora-Deck™ 800, Pecora-Deck™ 900, or Pecora Pro Sil) that have been customized for this specific purpose. However, there are other known suitable commercially available products that can be successfully used. These particular coatings are formulated to penetrate the outer surface of certain sheathing products and interlock with the facing material of the gypsum-based or wood-based surface, forming an integral membrane-like coating of approximately 3–5 mils thereon.

Secondly, these elastomeric membrane-like coating formulations have been modified for application during the sheathing manufacturing process or at the building site with a variety of different techniques, i.e. spray equipment, squeegee, paint brushes or rollers. The material formulation has been developed to promote rapid curing after installation during the in-line sheathing manufacturing process. Thirdly, a thinning agent, such as toluene or xylene has been added to improve the coating rheology for application and a fungicide has been added to retard the growth of fungi/mold.

Fourthly, these coatings bond tenaciously to sheet film as described and used in U.S. Pat. Nos. 6,401,401 and 6,401,402, and other construction materials as well. Fifthly, these elastomeric membrane-like coatings have self-sealing qualities when staples or other fasteners are applied. Sixthly, for some types of sheathings, in which the sheathing material itself forms the weather resistive barrier, the membrane-like coating is not required over the sheathing surfaces, but a specialized treatment at the joints between sheets of sheathing and through wall penetrations is required to control water intrusion and air movement through the exterior wall construction. This specialized treatment uses a unique joint taping system that may subsequently be covered with the membrane-like coating.

While the Remmele et al, '131 patent discloses an adhesive and seal layer applied to the outer surface of the exterior sheathing, it is followed by the installation of an insulation board, a first base coat, a mesh layer, a second base coat and finally, a finish coat of an acrylic base or silicone enhanced texture wall coating. It can readily be seen that this is a complicated, multi-step and time consuming process.

SUMMARY OF THE INVENTION

The instant invention uses a urethane or urethane/silicone membrane-like coating that is particularly compatible with the sheet flashing materials described in U.S. Pat. Nos. 6,401,401 and 6,401,402, therefore providing the ability to bond with the flashing material described therein The subject invention takes the art of moisture and air protection to the next level by providing a system that readily ties-in with the aforesaid patents of this inventor, thus providing an integrated system wherein encapsulation of an exterior wall building substrate and structure can be accomplished. It further includes a unique joint taping system that is applied over the exposed joints of the sheathing and through-wall penetrations to provide continuity of the membrane-like coating and weather resistive barrier. The particular tape used for sealing all joints comprises Valeron® Sheet Film (similar to the material described in U.S. Pat. Nos. 6,401,401 and 6,401,402) with pressure sensitive adhesive and a release strip on one side. Other suitable commercially available tapes may be used. Such tapes may also be covered with an additional coat of the elastomeric membrane-like material to enhance the durability of this joint.

OBJECTS OF THE INVENTION

An object of the invention is to provide an integrated weather resistive moisture barrier and air barrier system that minimizes the penetration of moisture and ingress and egress of air through the building enclosure's exterior wall.

A further object of the invention is to provide an integrated moisture/air barrier system that is readily adaptable to recent sheet flashing developments.

Another object of the invention is to provide an improved exterior sheathing product that includes a membrane-like moisture barrier coating integrally formed thereon.

Yet another object of the invention is to provide a unique elastomeric membrane-like coating material that is applied to exterior sheathing during the manufacturing process thereof.

A still further object of the invention is to provide a unique elastomeric membrane-like material that can be manually applied in-situ to wood or gypsum-based exterior sheathing in instances where the factory applied coating material is not available.

A further object of the invention is to provide a specialized taping system for use at the joints between sheets of the most common types of sheathing materials and through-wall penetrations to help ensure complete encapsulation of the structure undergoing protection.

Another object of the invention is to provide an integrated exterior moisture/air barrier system that mitigates moisture penetration, which otherwise may cause structural damage due to rotting.

Yet another object of the invention is to provide an integrated moisture/air barrier system that mitigates the growth of fungi or molds within the exterior wall construction.

These and other objects of the invention will become more apparent hereinafter. The instant invention will now be described with particular reference to the accompanying drawings that form a part of the specification wherein like reference characters designate the corresponding parts in the several views.

DETALED DESCRIPTION OF THE DRAWINGS

Figure 1:
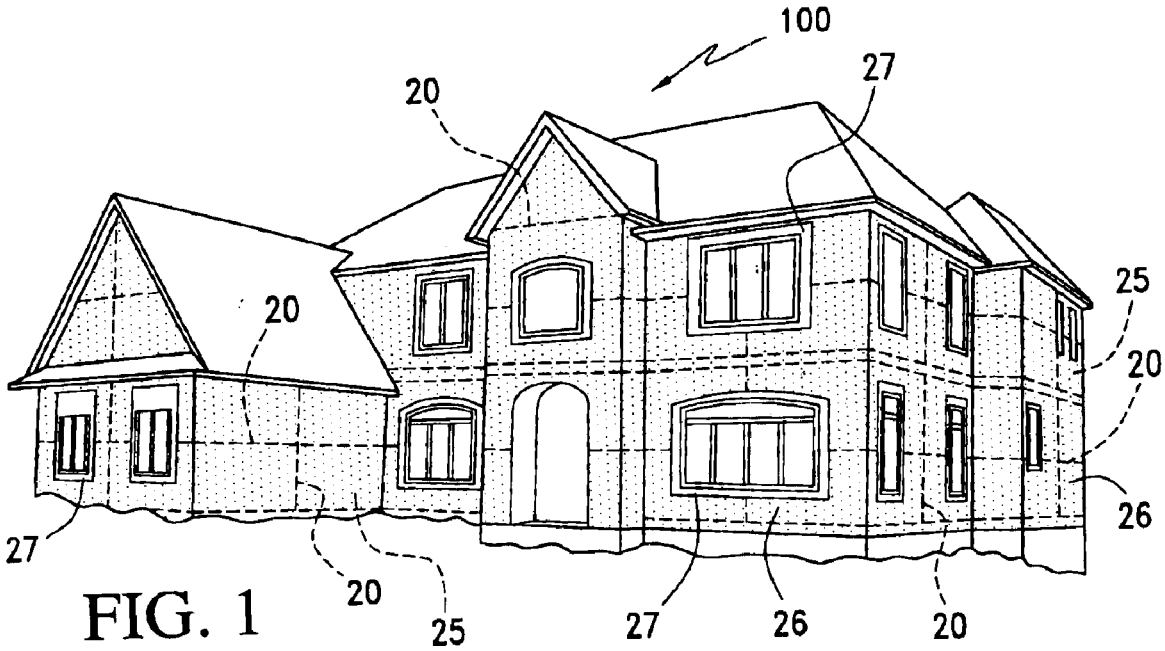
FIG. 1 is a perspective view of a single family residence illustrating installed exterior sheets of sheathing that have been treated with an elastomeric membrane-like coating and sheet flashing has been installed around the window rough openings.

Referring now to FIG. 1, there is shown a single family residence 100 under construction with exterior sheathing panels 25 that have been pre-coated with an elastomeric coating material 26. The exterior panels 25 are conventional sheathing panels made of wood, or gypsum-based materials or any combination thereof, that have been pre-coated with an elastomeric sealant material identified as Pecora-Deck™-800, Pecora-Deck™-900 or Pecora Pro Sil, commercially available products that have been used on systems designed to protect plywood decks, pool decks, tennis courts and the like. These products have been customized to reduce curing time and aid workability of the material. Additionally, a fungicide has been added to retard the growth of fungi/mold. It has been found that these products will tenaciously bond to each of the above noted sheathing panels 25 and also readily bonds to the Valeron® sheet materials 27 used for flashing that have been installed in the rough window openings prior to installation of the window units. The flashing materials 27 and their installation takes place in the manner set forth in U.S. Pat. Nos. 6,401,401 and 6,401,402, the subject matter of which is incorporated herein by reference.

Figure 4:
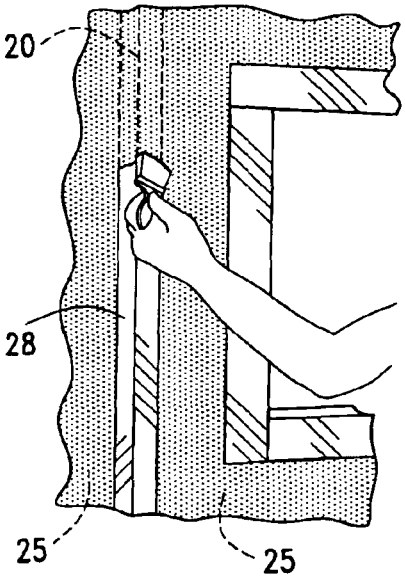
FIG. 4 is a view of the sample condition where the membrane-like coating is applied over the tape that has been applied over the outside corner condition between abutting sheets of sheathing.
Figure 5:
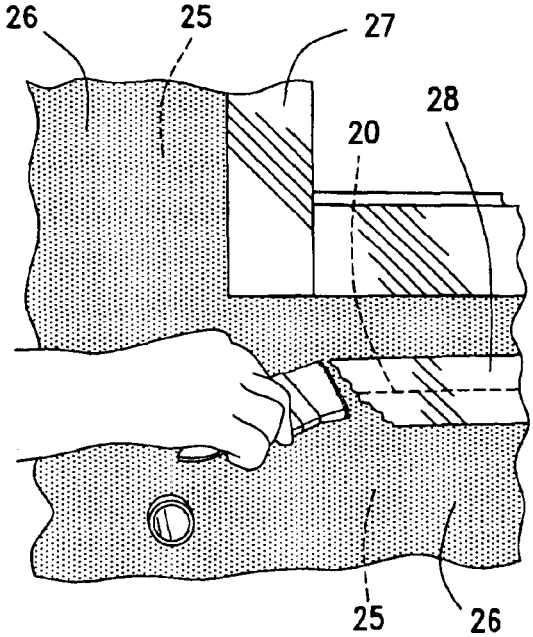
FIG. 5 is a view of the sample condition where the membrane-like coating is applied over the tape that has been installed to cover a butt joint between sheets of sheathing.

In this figure, sheathing joints 20 have been shown as light vertical and horizontal lines, however, in fact, these joints 20 will not be visible when joints 20 have been taped and coated in the manner set forth in FIGS. 4 and 5.

In addition to the membrane-like coated sheathing panels 25 and the flashing 27 of window rough openings, there is also the taping of abutting sheathing panel joints 20 that can be accomplished in either of two ways. One way, is through the use of Valeron® tape 28 (with or without a clay coating) that includes a peel-off strip with an adhesive thereunder and is applied directly over the sheathing joints 20. The second, optional way, is to utilize non-adhesive coated Valeron® sheet material 27 preceded by a coating of one of the Pecora products noted above. A similar treatment is applied to all through-wall penetrations of the exterior sheathing 25, including electrical lines, gas lines, water, etc. to provide a complete water protective envelope for the building. Each of these methods may be supplemented with an application of the elastomeric, membrane-like coating 26 over top of the Valeron® tape 28 or sheet material 27.

It has been found that the use of coated sheathing panels 25 with the Pecora materials set forth above, in combination with the Valeron® sheet material components 27 and Valeron® tape 28 provides the missing link required for encapsulation of the exterior wall surface of building structure 100 with an envelope that is highly resistant to water penetration and the formation of fungi/mold.

Figure 2:
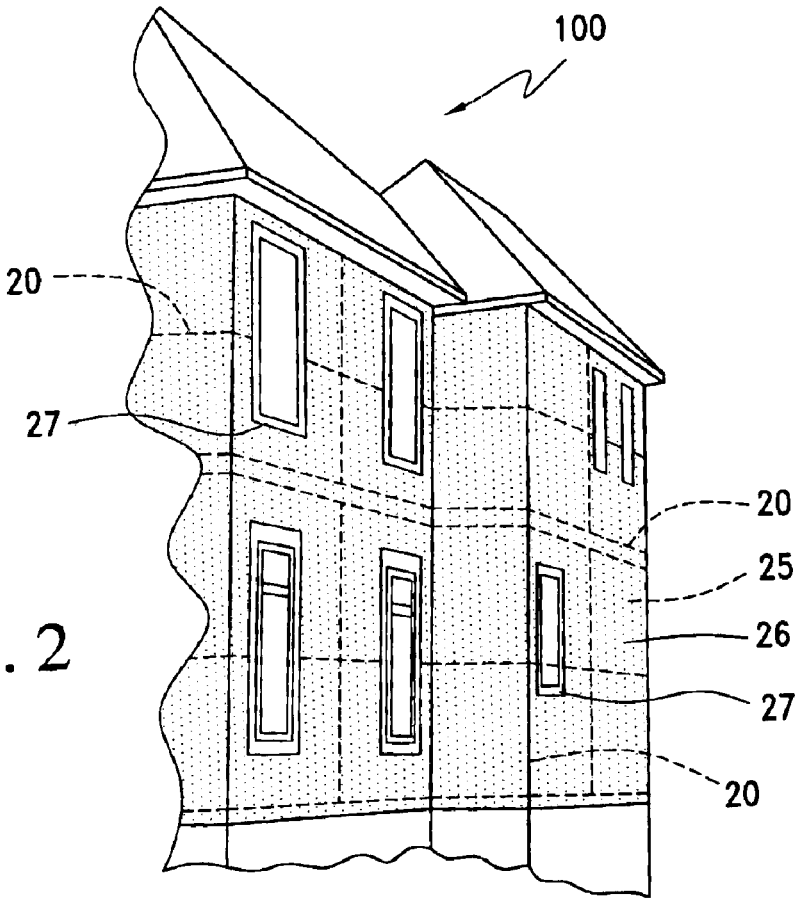
FIG. 2 is a close-up view of a portion of the building structure shown in FIG. 1, illustrating the tape applied over the sheathing joints and membrane-like coating applied over the tape.

FIG. 2 is a close-up view of a corner portion of the structure shown in FIG. 1. illustrating the sheathing panels 25 with the elastomeric membrane-like coating 26 applied thereover and flashing window components 27 in place and also the Valeron® tape 28 applied over abutting sheathing panels 25 to cover and seal the joint 20 therebetween.

Figure 3:
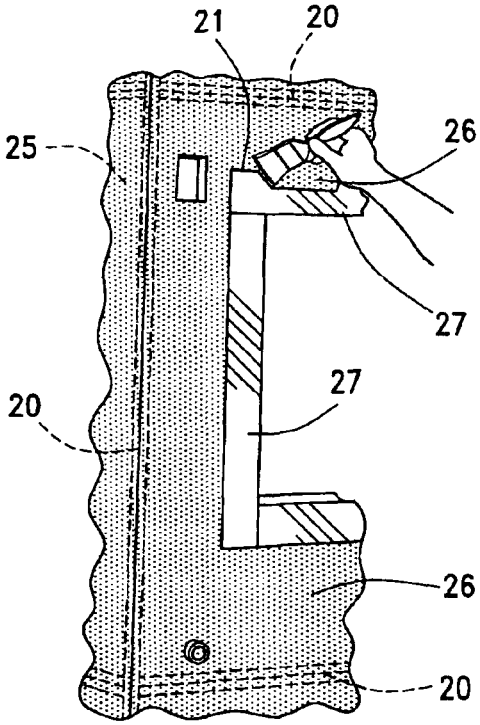
FIG. 3 is a view of the sample condition illustrating the application of a membrane-like coating over the top edge of the sheet flashing to prevent water from running behind the flashing pieces.

FIG. 3 is a view of a sample condition illustrating the treatment of a window rough opening after the clay coated flashing material 27 has been installed. In this view, there is an illustration of the manner in which the Pecora elastomeric membrane-like coating 26 is applied manually over the top edge of the window flashing material 27 to prevent water from entering behind the flashing pieces 27.

FIG. 4 is an illustration of the manner in which the Pecora elastomeric membrane-like coating 26 is applied to cover the Valeron® tape 28 of an outside corner condition between abutting sheets of exterior sheathing 25.

FIG. 5 is an illustration of the sample condition where the elastomeric membrane-like coating 26 is manually applied to Valeron® tape 28 that has been applied to cover the butt type joint 20 between abutting sheets of sheathing 25.

Figure 6:
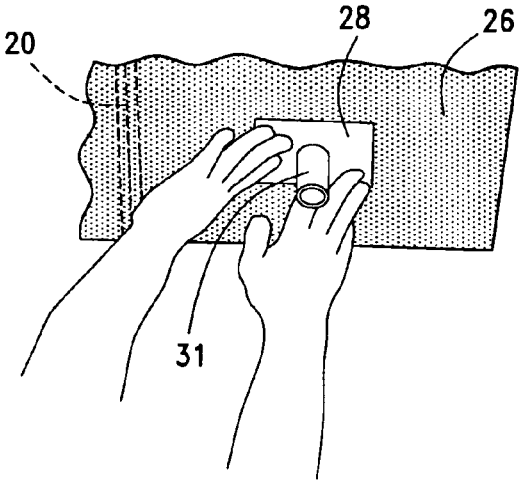
FIG. 6 is a view of the sample condition where the tape is being applied around an exterior through wall penetration (conduit pipe shown).
Figure 7:
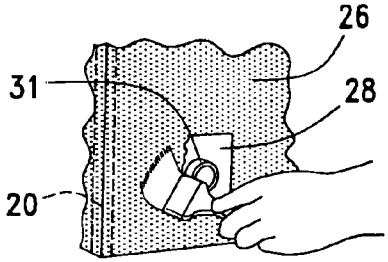
FIG. 7 is a view of the sample condition where the membrane-like coating is applied over the tape at an exterior through wall penetration.
Figure 8:
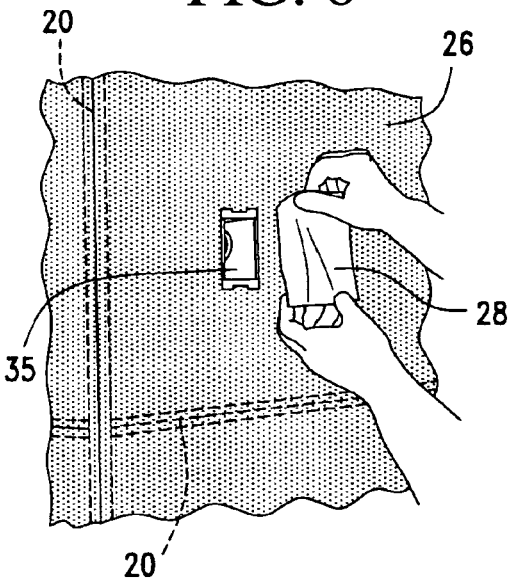
FIGS. 8–14 is a series of steps illustrating the treatment of an exterior electrical junction box.

FIG. 6 is a view of the sample condition where the joint tape 28 is being applied around a through-wall penetration formed by conduit/pipe 31. FIG. 7 illustrates the sample condition where the elastomeric membrane-like coating 26 is applied over the joint tape 28 around conduit/pipe 31.

Figure 9:
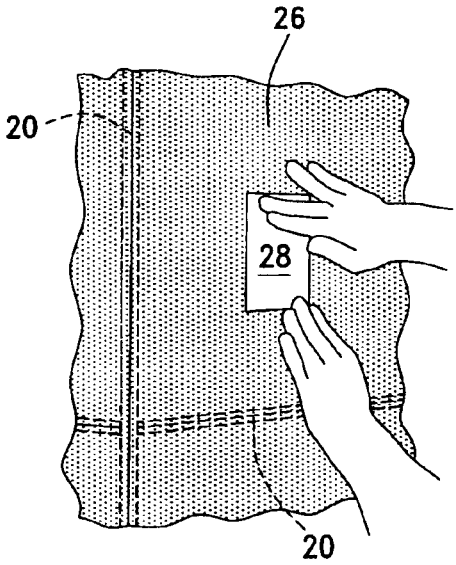
Figure 10:
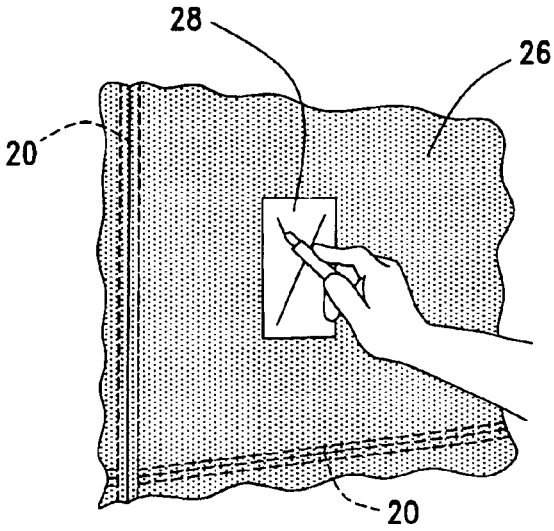
Figure 11:
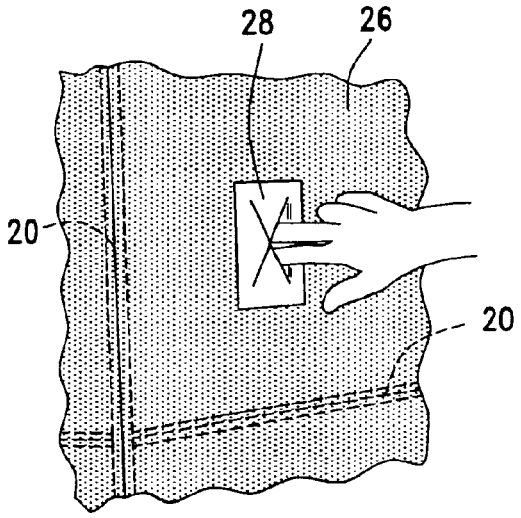
Figure 12:
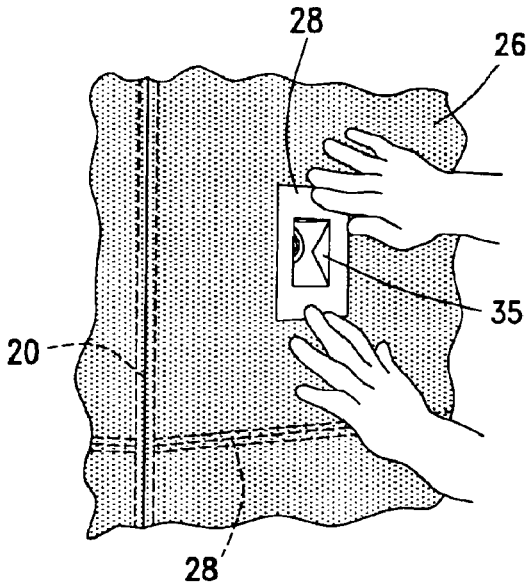
Figure 13:
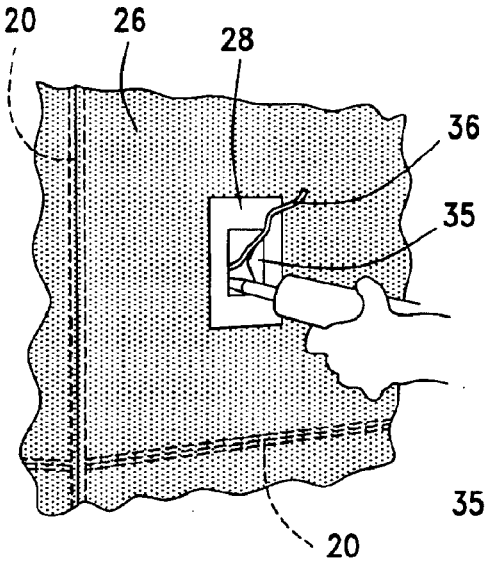
Figure 14:
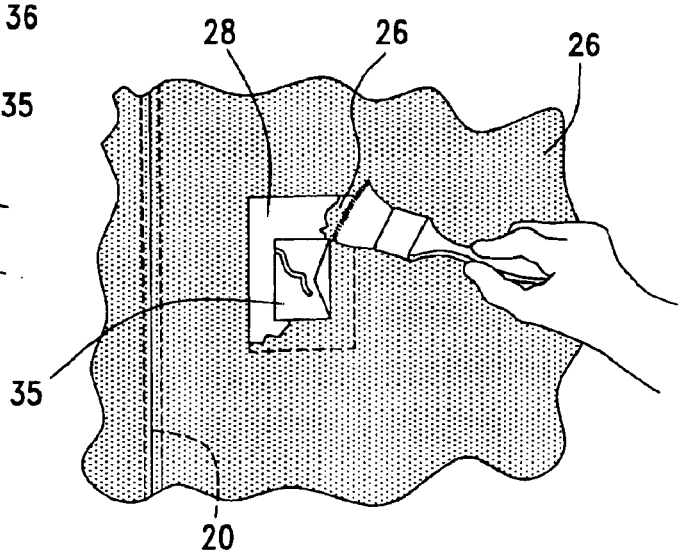

FIGS. 8–14 illustrate a series of steps taken to seal an exterior electrical junction box 35. FIG. 9 illustrates a piece of joint tape 28 applied over the junction box 35. Tape 28 can be either the self-adhesive type or the non-adhesive type. In the latter case, a coating of Pecora elastomeric membrane-like material would have been first applied to the sheathing surface 26 to bond the Valeron® sheet material 27 used for flashing thereto. FIG. 10 illustrates an "X"-cut being made in tape 28 with FIG. 11 showing the "X"-cut pushed back into the sides of electrical junction box 35. FIG. 12 shows the smoothing of tape 28 with the fingers to remove any air bubbles and ensure good contact with sheathing surface coating 26. FIG. 13 illustrates an electrical wire 36 extending from inside junction box 35 with the four portions of the "X" folded back onto the interior walls of junction box 35 and showing the application of construction sealant to the interior of the electrical junction box 35 where electrical wire 36 enters box 35. FIG. 14 is a view of the sample condition where the Pecora elastomeric membrane-like coating 26 is applied over Valeron® tape 28 at junction box 35.

Figure 15:
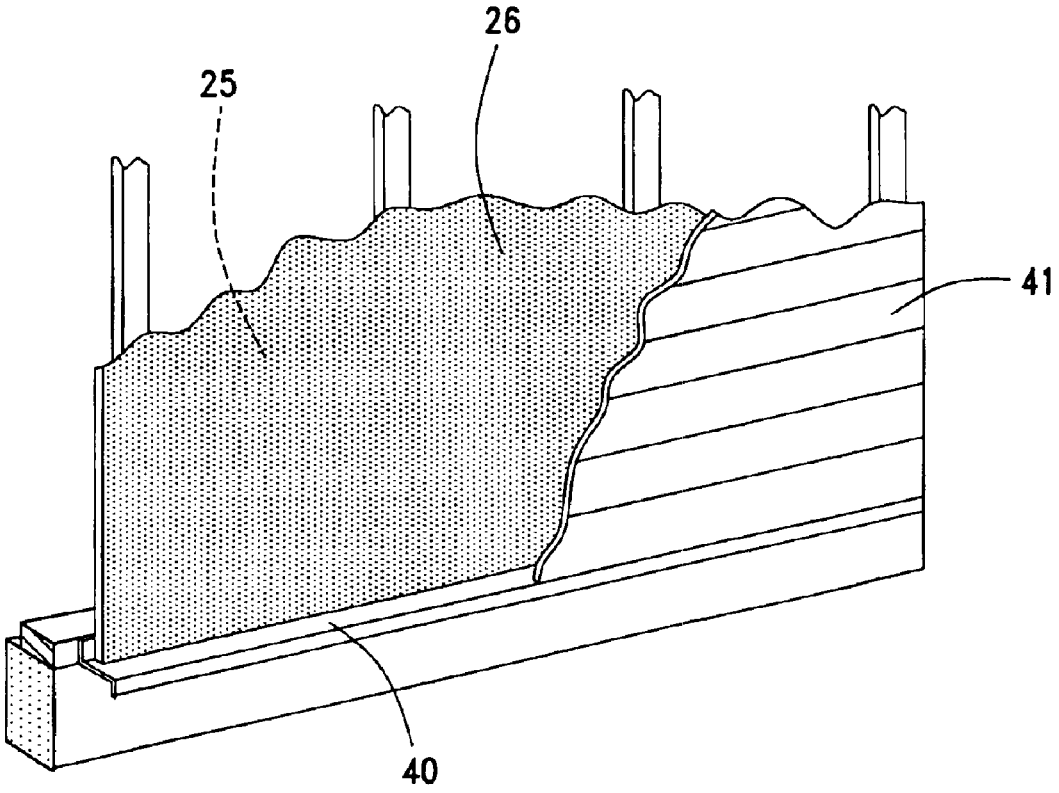
FIG. 15 is a view of the drainage track that is used to direct any water collecting between the exterior cladding and the membrane-like coated sheathing away from the building structure.

FIG. 15 is an illustration of drip track 40 that is installed at the lowermost ends of sheathing panels 25 to drain-off any water that has collected after running down between the outermost surface 26 of exterior sheathing panels 25 and exterior siding 41.

It appears that a review of the subject application and its relation to the aforementioned prior patents would be helpful to highlight its usefulness when combined therewith or alternatively, when used alone. The prior Williams et al, '026 deals mainly with th use of an an elastomeric flashing material, the composition of which is significantly different from the elastomeric membrane-like Pecora material used herein. The subsequently issued Williams '401 and '402 patents deal primarily with the use of clay coated sheet flashing materials that are utilized in flashing through-wall penetrations such as rough window and door openings. The instant invention deals primarily with coating exterior sheathing panels, i.e. wood or gypsum based panels or combinations thereof, with a membrane-like coating (Pecora-Deck™ or Pro Sil products) to resist the penetration of water and retard the growth of fungi/mold. Further, the instant invention includes a specialized treatment at the joints between sheets of the previously referenced sheathing, as well as other specialty sheathing products including rigid foam boards, (Owens Corning® Extruded Polystyrene or equal) toil-faced composition products, (Tyco Thermo PLy® or equal) or cementitious panels, (National GypsumCompany Perma Base® or equal). As indicated earlier, it has been discovered that this unique elastomeric membrane-like coating 26 will tenaciously bond to the clay coated polyethylene sheet flashing materials of the earlier patents to provide encapsulation of a building's exterior wall, thus reducing or possibly eliminating the very serious problem of moisture penetration that causes structural rotting and fungi/mold growth.

While the invention has been described in its preferred embodiments, it is to be understood that the words that have been used are words of description rather than words of limitation and that changes may be made within the purview of the appended claims without departing from the full scope or spirit of the invention.

I claim:

1. An integrated system for controlling water intrusion and air movement through exterior wall construction comprising:

a building enclosure having a plurality of exterior sheathing wall panels secured thereto with a plurality of joints between said exterior sheathing wall panels, a plurality of through-wall penetrations extending through said plurality of exterior sheathing wall panels at specified locations;

each of said exterior sheathing wall panels having specialized outer treatment means comprising an elastomeric membrane-like coating having self-sealing qualities on its outermost surface that provides an air and moisture barrier means for mitigating the penetration of air and water into said exterior sheathing wall panels, joint protection means including a clay-coated adhesive backed tape that is applied thereover followed by a manually applied coating of said elastomeric membrane-like material for mitigating the penetration of air and water through said plurality of joints between said exterior sheathing wall panels; and collecting means for draining any water on the exterior facing of said exterior sheathing wall panels whereby said exterior sheathing wall panels with said specialized outer treatment means mitigates the penetration of air and water through said exterior sheathing wall panels and any condensate or water collecting thereon can drain away from said building wall structure and retards the accumulation of moisture and fungi/mold in said building structure.

2. An integrated system for controlling water intrusion and air movement of the character defined in claim 1 wherein said elastomeric membrane-like coating with self-sealing qualities is applied to said plurality of exterior sheathing wall panels for mitigating intrusion of air and water therethrough; and said elastomeric membrane-like coating having been applied during the manufacture of said sheathing wall panels.

3. An integrated system for controlling water intrusion and air movement of the character defined in claim 1 wherein said elastomeric membrane-like coating with self-sealing qualities is applied to said plurality of sheathing wall panels in-situ during construction.

4. An integrated system for controlling water and air movement of the character defined in claim 2 wherein said exterior sheathing wall panels are wood-based products and said specialized outer treatment means further includes a thinning agent to improve workability and a fungicide for retarding the growth of fungi/mold.

5. An integrated system for controlling water intrusion and air movement of the character defined in claim 2 wherein said exterior sheathing wall panels are gypsum-based panels and said specialized outer treatment means further includes a thinning agent to improve the workability and a fungicide to retard the growth of fungi/mold.

6. An integrated system for controlling water intrusion and air movement of the character defined in claim 4 wherein said joint protecting means includes a coating of an elastomeric membrane-like material on abutting exterior sheathing wall panel edges forming said joint and a clay coated sheet flashing material is applied thereover followed by a second coating of elastomeric membrane-like material over said clay coated sheet flashing material to further seal said joint against air and moisture penetration therethrough.

7. An integrated system for controlling water and air movement of the character defined in claim 5 wherein said joint protecting means includes a coating of an elastomeric membrane-like material on abutting exterior sheathing wall panels edges forming said joint and a clay coated sheet flashing material is applied thereover followed by a second coating of elastomeric membrane-like material over said clay coated sheet flashing material to further seal said joint against air and moisture penetration.

8. An integrated system for controlling water intrusion and air movement of the character defined in claim 4 wherein said joint protecting means includes a coating of an elastomeric membrane-like material on abutting exterior sheathing wall panel edges forming said joint and a layer of clay coated sheet flashing material is applied thereover to further seal said joint against air and moisture penetration therethrough.

9. An integrated system for controlling water intrusion and air movement of the character defined in claim 5 wherein said joint protecting means includes a coating of elastomeric membrane-like material on abutting exterior sheathing wall panel edges forming said joint and a layer of coated sheet flashing material is applied thereover to seal said joint against air and moisture penetration therethrough.

10. An integrated system for controlling water intrusion and air movement as defined in claim 5 wherein said through-wall penetrations are rough window openings that have been flashed with clay coated sheet flashing material and a coating of elastomeric membrane-like material that readily bonds said sheet flashing material to said specialized outer treatment means of said exterior sheathing wall panels to mitigate air and water intrusion therearound.

11. An integrated system for controlling water intrusion and air movement of the character defined in claim 4 wherein said through-wall penetration is an exterior electrical junction box that has been protected with clay coated sheet flashing material that is applied over said junction box followed by a manually applied coating of said elastomeric membrane-like coating material to further enhance and secure said closure protection thereat.

12. An integrated system for controlling water intrusion and air movement as defined in claim 5 wherein said through-wall penetrations is an exterior electrical junction box that has been protected with clay coated sheet flashing material that is applied over said junction box followed by a manually applied coating of said elastomeric membrane-like coating material to further enhance and secure said closure protection thereat.

13. An integrated system for controlling water intrusion and air movement of the character defined in claim 4 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

14. An integrated system for controlling water intrusion and air movement of the character defined in claim 5 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

15. An integrated system for controlling water intrusion and air movement as defined in claim 4 wherein said through-wall penetration is an utility conduit that has been protected with clay coated sheet flashing material that is applied around said utility conduit followed by a manually applied coating of said elastomeric membrane-like coating material to further enhance and secure said closure thereat.

16. An integrated system for controlling water intrusion and air movement as defined in claim 5 wherein said through-wall penetration is an utility conduit that has been protected with clay coated sheet flashing material that is applied around said utility conduit followed by a manually applied coating of said elastomeric membrane-like coating material to further enhance and secure said closure thereat.

17. An integrated system for controlling water intrusion and air movement of the character defined in claim 4 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

18. An integrated system for controlling water intrusion and air movement of the character defined in claim 5 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

19. An integrated system for controlling water intrusion and air movement of the character defined in claim 4 wherein said joints are butt joints between adjacent exterior sheathing wall panels and said joint protection means includes a clay coated adhesive-backed tape placed over said butt joints whereby said joint is sealed against air and water penetration therethrough.

20. An integrated system for controlling water intrusion and air movement of the character defined in claim 5 wherein said joints are butt joints between adjacent exterior sheathing wall panels and said joint protection means includes a clay coated adhesive-backed tape placed over said butt joints whereby said joint is sealed against air and water penetration therethrough.

21. An integrated system for controlling water intrusion and air movement of the character defined in claim 4 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

22. An integrated system for controlling water intrusion and air movement of the character defined in claim 5 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

23. An integrated system for controlling water intrusion and air movement of the character defined in claim 4 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

24. An integrated system for controlling water intrusion and air movement of the character defined in claim 5 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

25. An integrated system for controlling water intrusion and air movement of the character defined in claim 4 wherein said joints are corner joints formed at corner locations by said exterior sheathing wall panels that have been protected with clay coated sheet flashing material that is applied over said corner joints followed by a manually applied coating of said elastomeric membrane-like material to further enhance sealing whereby said corner joint is sealed against air and water penetration therethrough.

26. An integrated system for controlling water intrusion and air movement of the character defined in claim 5 wherein said joints are corner joints formed at corner locations by said exterior sheathing wall panels that have been protected with clay coated sheet flashing material that is applied over said corner joints followed by a manually applied coating of said elastomeric membrane-like material to further enhance sealing whereby aid corner joint is sealed against air and water penetration therethrough.

27. An integrated system for controlling water and air movement of the character defined in claim 3 wherein said exterior sheathing wall panels are wood-base products and said specialized outer treatment means further includes a thinning agent to improve workability and fungicide for retarding the growth of fungi/mold.

28. An integrated system for controlling water intrusion and air movement of the character defined in claim 27 wherein said joint protecting means includes a clay-coated adhesive backed tape that is applied thereover followed by a manually applied coating of said elastomeric membrane-like material to further enhance and secure said joint protection thereat.

29. An integrated system for controlling water intrusion and air movement of the character defined in claim 27 wherein said joint protecting means includes a coating of an elastomeric membrane-like material on abutting exterior sheathing wall panel edges forming said joint and a clay coated sheet flashing material is applied thereover followed by a second coating of elastomeric membrane-like material over said clay coated sheet flashing material to further seal said joint against air and moisture penetration therethrough.

30. An integrated system for controlling water intrusion and air movement of the character defined in claim 27 wherein said joint protecting means includes a coating of an elastomeric membrane-like material on abutting exterior sheathing wall panel edges forming said joint and said clay coated sheet flashing material is applied thereover to further seal said joint against air and moisture penetration therethrough.

31. An integrated system for controlling water intrusion and air movement as defined in claim 27 wherein said through-wall penetrations are rough window openings that have been flashed with clay coated sheet flashing material and a coating of elastomeric membrane-like material that readily bonds said sheet flashing material to said specialized outer treatment means of said exterior sheathing wall panels to mitigate air and water intrusion therearound.

32. An integrated system for controlling water intrusion and air movement as defined in claim 31 wherein said clay coated sheet flashing material at said through-wall penetrations have been supplemented with clay coated adhesive-backed tape that readily bonds to said clay coated sheet flashing material and said air and water barrier means of said exterior sheathing wall panels to mitigate air and water intrusion therearound.

33. An integrated system for controlling water intrusion as defined in claim 32 wherein a further coating of said elastomeric membrane-like material is applied over said adhesive-backed tape to further enhance and secure said protection thereat.

34. An integrated system for controlling water intrusion and air movement of the character defined in claim 27 wherein said through-wall penetration is an exterior electrical junction box that has been protected with clay coated sheet flashing material that is applied over said junction box followed by a manually applied coating of said elastomeric membrane-like coating material to further enhance and secure said closure protection thereat.

35. An integrated system for controlling water intrusion and air movement of the character defined in claim 27 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

36. An integrated system for controlling water intrusion and air movement as defined in claim 27 wherein said through-wall penetration is an utility conduit that has been protected with clay coated sheet flashing material that is applied around said utility conduit followed by a manually applied coating of said elastomeric membrane-like coating material to further enhance and secure said closure thereat.

37. An integrated system for controlling water intrusion and air movement of the character defined in claim 27 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

38. An integrated system for controlling water intrusion and air movement of the character defined in claim 27 wherein said joints are butt-joints between adjacent exterior sheathing wall panels and said joint protection means includes a clay coated sheet flashung material that is applied over said butt joints followed by a coating of said elastomeric membrane-like material thereover to further enhance sealing whereby said joint is sealed against air and water penetration therethrough.

39. An integrated system for controlling water intrusion and air movement of the character defined in claim 27 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

40. An integrated system for controlling water intrusion and air movement of the character defined in claim 27 wherein said joints are corner joints formed at corner locations by said exterior sheathing wall panels that have been protected with clay coated sheet flashing material that is applied over said corner joints followed by a manually applied coating of said elastomeric membrane-like material to further enhance sealing whereby said corner joint is sealed against air and water penetration therethrough.

41. An integrated system for controlling water intrusion and air movement of the character defined in claim 3 wherein said exterior sheathing wall panels are gypsum-based panels and said specialized outer treatment means further includes a thinning agent to improve the workability and a fungicide to retard the growth of fungi/mold.

42. An integrated system for controlling water intrusion and air movement of the character defined in claim 41 wherein said joint protecting means includes a clay-coated adhesive backed tape that is applied thereover followed by a manually applied coating of said elastomeric membrane-like material to further enhance and secure said joint protection thereat.

43. An integrated system for controlling water and air movement of the character defined in claim 41 wherein said joint protecting means includes a coating of an elastomeric membrane-like material on abutting exterior sheathing wall panels edges forming said joint and a clay coated sheet flashing material is applied thereover followed by a second coating of elastomeric membrane-like material over said clay coated sheet flashing material to further seal said joint against air and moisture penetration.

44. An integrated system for controlling water intrusion and air movement of the character defined in claim 41 wherein said joint protecting means includes a coating of elastomeric membrane-like material on abutting exterior sheathing wall panel edges forming said joint and said clay coated sheet flashing material is applied thereover to seal said joint against air and moisture penetration therethrough.

45. An integrated system for controlling water intrusion and air movement as defined in claim 41 wherein said through-wall penetrations are rough window openings that have been flashed with clay coated sheet flashing material and a coating of elastomeric membrane-like material that readily bonds said sheet flashing material to said specialized outer treatment means of said exterior sheathing wall panels to mitigate air and water intrusion therearound.

46. An integrated system for controlling water intrusion and air movement as defined in claim 41 wherein said through-wall penetrations is an exterior electrical junction box that has been protected with clay coated sheet flashing material that is applied over said junction box followed by a manually applied coating of said elastomeric membrane-like coating material to further enhance and secure said closure protection thereat.

47. An integrated system for controlling water intrusion and air movement of the character defined in claim 41 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

48. An integrated system for controlling water intrusion and air movement of the character defined in claim 41 wherein said through-wall penetration is a utility conduit that has been protected with clay coated sheet flashing material that is applied around said utility conduit followed by a manually applied coating of said elastomeric membrane-like coating material thereover to further enhance and secure said closure protection thereat.

49. An integrated system for controlling water intrusion and air movement of the character defined in claim 41 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

50. An integrated system for controlling water intrusion and air movement of the character defined in claim 41 wherein said joints are butt joints between adjacent exterior sheathing wall panels and said joint protection means includes a clay coated adhesive-backed tape placed over said butt joints whereby said joint is sealed against air and water penetration therethrough.

51. An integrated system for controlling water intrusion and air movement of the character defined in claim 41 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

52. An integrated system for controlling water intrusion and air movement of the character defined in claim 41 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

53. An integrated system for controlling water intrusion and air movement of the character defined in claim 41 wherein said joints are corner joints formed at corner locations by said exterior sheathing wall panels that have been protected with clay coated sheet flashing material that is applied over said corner joints followed by a manually applied coating of elastomeric membrane-like material to further enhance sealing whereby said corner joints are sealed against air and water penetration therehtrough.

54. An integrated system for controlling water intrusion and air movement as defined in claim 41 wherein said clay coated sheet flashing material at said through-wall penetrations have been supplemented with clay coated adhesive-backed tape that readily bonds to said clay coated sheet flashing material and said air and water barrier means of said exterior sheathing wall panels to mitigate air and water intrusion therearound.

55. An integrated system for controlling water intrusion as defined in claim 54 wherein a further coating of said elastomeric membrane-like material is applied over said adhesive-backed tape to further enhance and secure said protection thereat.

56. An integrated system for controlling water intrusion and air movement of the character defined in claim 41 wherein said joints are butt joints between adjacent exterior sheathing wall panels and said joint protection means includes a clay coated sheet flashing material that is applied over said butt joints followed by a coating of said elastomeric membrane-like material thereover to further enhance sealing whereby said joint is sealed against air and water penetration therethrough.

57. An integrated system for controlling water intrusion and air movement of the character defined in claim 27 wherein said joints are butt joints between adjacent exterior sheathing wall panels and said joint protection means includes a clay coated adhesive-backed tape placed over said butt joints whereby said joint is sealed against air and water penetration therethrough.

58. An integrated system for controlling water intrusion and air movement of the character defined in claim 27 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

59. An integrated system for controlling water intrusion and air movement through exterior wall construction comprising:

a building enclosure having a plurality of exterior sheathing wall panels secured thereto with a plurality of joints between said exterior sheathing panels;

a plurality of through-wall penetrations extending through said plurality of exterior sheathing wall panels at specified locations;

said through-wall penetrations being rough window openings that have been flashed with clay coated sheet flashing material and a coating of elastomeric membrane-like material that readily bonds said sheet flashing material to said specialized outer treatment means of said exterior sheathing wall panels to mitigate air and water intrusion therearound;

each of said exterior sheathing wall panels having a treated outermost surface that has an elastomeric membrane-like coating with self-sealing qualities and is integral with said sheathing wall panel for retarding the penetration of air and water into said exterior sheathing wall panels;

joint protection means for mitigating the penetration of air and water through said plurality of joints between said exterior sheathing wall panels;

said joint protection means including an adhesive backed joint tape overlapping said joints whereby the outer surface of the wall structure is sealed against air and water intrusion.

60. An integrated system for controlling water intrusion and air movement of the character defined in claim 59 wherein said exterior sheathing wall panels are foam board.

61. An integrated system for controlling water intrusion and air movement of the character defined in claim 59 wherein said exterior sheathing wall panels are foil-faced.

62. An integrated system for controlling water intrusion and air movement of the character defined in claim 59 wherein said exterior sheathing wall panels are cement based boards.

63. An integrated system for controlling water intrusion and air movement as defined in claim 60 wherein said through-wall penetrations are rough window openings that have been flashed with clay coated sheet flashing material and a coating of elastomeric membrane-like material that readily bonds said sheet flashing material to said specialized outer treatment means of said exterior sheathing wall panels to mitigate air and water intrusion therearound.

64. An integrated system for controlling water intrusion and air movement as defined in claim 61 wherein said through-wall penetrations are rough window openings that have been flashed with clay coated sheet flashing material and a coating of elastomeric membrane-like material that readily bond said sheet flashing material to said specialized outer treatment means of said exterior sheathing wall panels to mitigate air and water intrusion therearound.

65. An integrated system for controlling water intrusion and air movement as defined in claim 62 wherein said through-wall penetrations are rough window openings that have been flashed with clay coated sheet flashing material and a coating of elastomeric membrane-like material that readily bonds said sheet flashing material to said specialized outer treatment means of said exterior sheathing wall panels to mitigate air and water intrusion therearound.

66. An integrated system for controlling water intrusion and air movement as defined in claim 59 wherein said clay coated sheet flashing material at said through-wall penetrations have been supplemented with clay coated adhesive-backed tape that readily bonds to said clay coated sheet flashing material and said air and water barrier means of said exterior sheathing wall panels to mitigate air and water intrusion therearound.

67. An integrated system for controlling water intrusion as defined in claim 66 wherein a further coating of said elastomeric membrane-like material is applied over said adhesive-backed tape to further enhance and secure said protection thereat.

68. An integrated system for controlling water intrusion and air movement as defined in claim 60 wherein said through-wall penetrations is an exterior electrical junction box that has been protected with clay coated sheet flashing material that is applied over said junction box followed by a manually applied coating of said elastomeric membrane-like coating material to further enhance and secure said closure protection thereat.

69. An integrated system for controlling water intrusion and air movement as defined in claim 61 wherein said through-wall penetrations is an exterior electrical junction box that has been protected with clay coated sheet flashing material that is applied over said junction box followed by a manually applied coating of said elastomeric membrane-like coating material to further enhance and secure said closure protection thereat.

70. An integrated system for controlling water intrusion and air movement as defined in claim 62 wherein said through-wall penetrations is an exterior electrical junction box that has been protected with clay coated sheet flashing material that is applied over said junction box followed by a manually applied coating of said elastomeric membrane-like coating material to further enhance and secure said closure protection thereat.

71. An integrated system for controlling water intrusion and air movement of the character defined in claim 60 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

72. An integrated system for controlling water intrusion and air movement of the character defined in claim 61 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

73. An integrated system for controlling water intrusion and air movement of the character defined in claim 62 wherein said through-wall penetration is an exterior electrical junction box that has been protected with clay coated adhesive-backed tape that is applied over said junction box followed by a manually applied coating of said elastomeric membrane-like coating material thereover to further enhance and secure said closure protection thereat.

74. An integrated system for controlling water intrusion and air movement as defined in claim 60 wherein said through-wall penetration is an utility conduit that has been protected with clay coated sheet flashing material that is applied around said utility conduit followed by a manually applied coating of said elastomeric membrane-like coating material to further enhance and secure said closure thereat.

75. An integrated system for controlling water intrusion and air movement as defined in claim 61 wherein said through-wall penetration is an utility conduit that has been protected with clay coated sheet flashing material that is applied around said utility conduit followed by a manually applied coating of said elastomeric membrane-like coating material to further enhance and secure said closure thereat.

76. An integrated system for controlling water intrusion and air movement as defined in claim 62 wherein said through-wall penetration is an utility conduit that has been protected with clay coated sheet flashing material that is applied around said utility conduit followed by a manually applied coating of said elastomeric membrane-like coating material to further enhance and secure said closure thereat.

77. An integrated system for controlling water intrusion and air movement of the character defined in claim 60 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

78. An integrated system for controlling water intrusion and air movement of the character defined in claim 61 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

79. An integrated system for controlling water intrusion and air movement of the character defined in claim 62 wherein said through-wall penetration is an utility conduit that has been protected with clay coated adhesive-backed tape that is applied around said utility conduit followed by a manually applied coating of said elastomeric membrane-like coating material thereover to further enhance and secure said closure protection thereat.

80. An integrated system for controlling water intrusion and air movement of the character defined in claim 60 wherein said joints are butt joints between adjacent exterior sheathing wall panels and said joint protection means includes a clay coated adhesive-backed tape placed over said butt joints whereby said joint is sealed against air and water penetration therethrough.

81. An integrated system for controlling water intrusion and air movement of the character defined in claim 61 wherein said joints are butt joints between adjacent exterior sheathing wall panels and said joint protection means includes a clay coated adhesive-backed tape placed over said butt joints whereby said joint is sealed against air and water penetration therethrough.

82. An integrated system for controlling water intrusion and air movement of the character defined in claim 62 wherein said joints are butt joints between adjacent exterior sheathing wall panels and said joint protection means includes a clay coated adhesive-backed tape placed over said butt joints whereby said joint is sealed against air and water penetration therethrough.

83. An integrated system for controlling water intrusion and air movement of the character defined in claim 60 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

84. An integrated system for controlling water intrusion and air movement of the character defined in claim 61 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

85. An integrated system for controlling water intrusion and air movement of the character defined in claim 62 wherein said joints are butt joints between adjacent exterior sheathing wall panels and said joint protection means includes a clay coated adhesive-backed tape placed over said butt joints followed by a coating of said elastomeric membrane-like material thereover to further enhance sealing whereby said joint is sealed against air and water penetration therethrough.

86. An integrated system for controlling water intrusion and air movement of the character defined in claim 60 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

87. An integrated system for controlling water intrusion and air movement of the character defined in claim 61 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

88. An integrated system for controlling water intrusion and air movement of the character defined in claim 62 wherein said joints are corner joints formed at corner locations by said exterior sheathing wall panels and the contacting edges of said corner joint are first covered with a clay coated adhesive-backed tape placed over said corner joints followed by a coating of said elastomeric membrane-like material thereover to further enhance sealing whereby said joint is sealed against air and water penetration therethrough.

89. An integrated system for controlling water intrusion and air movement of the character defined in claim 60 wherein said joints are corner joints formed at corner locations by said exterior sheathing wall panels that have been protected with clay coated sheet flashing material that is applied over said corner joints followed by a manually applied coating of said elastomeric membrane-like material to further enhance sealing whereby aid corner joint is sealed against air and water penetration therethrough.

90. An integrated system for controlling water intrusion and air movement of the character defined in claim 61 wherein said joints are corner joints formed at corner locations by said exterior sheathing wall panels that have been protected with clay coated sheet flashing material that is applied over said corner joints followed by a manually applied coating of said elastomeric membrane-like material to further enhance sealing whereby aid corner joint is sealed against air and water penetration therethrough.

91. An integrated system for controlling water intrusion and air movement of the character defined in claim 62 wherein said joints are corner joints formed at corner locations by said exterior sheathing wall panels that have been protected with clay coated sheet flashing material that is applied over said corner joints followed by a manually applied coating of said elastomeric membrane-like material to further enhance sealing whereby aid corner joint is sealed against air and water penetration therethrough.

92. An integrated system for controlling water intrusion and air movement of the character defined in claim 59 further including collecting means for draining any water on the exterior facing of said exterior sheathing wall panels whereby said exterior sheathing wall panels with their treated outermost surface mitigates the penetration of air and water through said exterior sheathing wall panels and any condensation or water collecting thereon can drain away from said building structure and retards the accumulation of moisture and fungi/mold in said building structure.

* * * * *

UNITED STATES PATENT AND TRADEMARK OFFICE

CERTIFICATE OF CORRECTION

PATENT NO. : 6,868,643 B1
DATED : March 22, 2005
INVENTOR(S) : Mark F. Williams

It is certified that error appears in the above-identified patent and that said Letters Patent is hereby corrected as shown below:

Column 10,
Line 60, after "whereby", "aid" should read -- said --

Column 18,
Lines 33, 42 and 51, after "whereby", "aid" should read -- said --

Signed and Sealed this

Thirty-first Day of May, 2005

JON W. DUDAS
*Director of the United States Patent and Trademark Office*